United States Patent [19]

Geiger

[11] 3,987,989

[45] Oct. 26, 1976

[54] RAILWAY SIGNAL SYSTEM

[75] Inventor: Willard L. Geiger, Chagrin Falls, Ohio

[73] Assignee: Erico Rail Products Company, Cleveland, Ohio

[22] Filed: Apr. 16, 1975

[21] Appl. No.: 568,565

Related U.S. Application Data

[63] Continuation-in-part of Ser. No. 458,172, April 5, 1974, Pat. No. 3,929,307, which is a continuation-in-part of Ser. No. 348,944, April 9, 1973, Pat. No. 3,850,390.

[52] U.S. Cl. ..... 246/34 R; 246/125

[51] Int. Cl.[2] ..... B61L 21/06

[58] Field of Search..... 246/34 R, 34 CT, 121, 246/125, 128, 130 R, 40

[56] References Cited

UNITED STATES PATENTS

| | | | |
|---|---|---|---|
| 2,975,272 | 3/1961 | Renick | 246/34 R |
| 3,696,243 | 10/1972 | Risely | 246/121 |
| 3,777,139 | 12/1973 | Peel | 246/125 |

*Primary Examiner*—Trygve M. Blix
*Assistant Examiner*—Reinhard J. Eisenzopf
*Attorney, Agent, or Firm*—D. A. N. Chase

[57] ABSTRACT

A railway signal system detects a train approaching the system tie points to a railroad track by transmitting in the track a modulated AC carrier wave signal, which is attenuated by the variable shunt effect of an approaching train, and monitoring the track signal in a receiver that responds to signal variations caused by such an approaching train to drop a signal relay, which operates a gate, flasher, or the like at a grade crossing. The track signal is normally automatically regulated to be within a voltage window, and a continuous system latch up feature precludes pick up of the signal relay upon occurrence of a broken rail or high track signal, for example, caused by a very high impedance ballast, until manually reset. A time delay circuit delays pick up of the signal relay after motion has been first detected, and a bypass circuit for a low track signal detector allows system operation even after an unexpected shunt occurs on a monitored section of track. Moreover, an automatic gain control in the receiver reduces ring-by time to a minimum when a train leaves the system tie points, which define a monitored track island.

56 Claims, 6 Drawing Figures

RAILWAY SIGNAL SYSTEM

This patent application is a continuation-in-part of my copending U.S. patent application Ser. No. 458,172, filed Apr. 5, 1974, for "Railway Signal System With Speed Determined Movement Detector", now U.S. Pat. No. 3,929,307, issued Dec. 30, 1975, which is a continuation-in-part of my U.S. patent application Ser. No. 348,944, filed Apr. 9, 1973, now U.S. Pat. No. 3,850,390, issued Nov. 26, 1974, for "Railway Signal System With Speed Determined Movement Detector", all of which are assigned to the same assignee.

BACKGROUND OF THE INVENTION

This invention relates to a fail-safe railway signal system for detecting an approaching train on a track and more particularly relates to such a system that operates one or more signal relays to indicate such a train approaching a grade crossing, a track section in a block signal system, or the like. The invention will, however, be described below applicable to pick up or to drop a signal relay at a grade crossing, which will effect pick up or dropping of a crossing gate, although it is to be understood that the system output signal may be used to operate other signalling devices, computers and the like.

Pertinent prior art railway signal systems for detecting approaching trains have used various techniques to compensate for train approach distance and speed to achieve minimum down time during which a signal device is activated or a control signal is generated to provide appropriate indications, for example, at a grade crossing or at another track section, whenever a train is approaching, existing in or leaving a crossing area or track section. The control signal may be coupled to a control system including, for example, a computer for automated train control, or may be used to operate a relay, signal lights or the like. Conventionally, the railway signal systems develop an output signal used to pick up or to drop a signal relay that provides electrical isolation between the lower power signal system and the higher power crossing gate operating motor or the like.

Several existing signal systems respond only to a train within the island between the transmitted and the receiver tie points to the track, requiring long islands to provide train detection within a safe time, and the long island increases the difficulty of system installation. Other devices respond to train approach speed, but do not include variable sensitivity features, such devices often requiring plural systems operating at different frequencies for achieving a minimum safe down time of the sigal device. In still other devices train detection at locations outside the island is achieved using a first signal frequency and train detection within the island is achieved using a second signal frequency in order that the system operating on the first signal frequency may recover while the train is in the island, thereby reducing ring-by time required for recovery of the signal relay as soon as the train leaves the island.

One disadvantage with prior art railway signal systems is that without variable sensitivity, a train consisting of only a single car and/or engine may accelerate after approach time prediction to put the engine almost in the crossing before gate actuation, and another disadvantage is relatively long ring-by time, which is a nuisance to motorists. The effectiveness of prior art systems over a wide range of track ballast conditions is limited, and such systems are not automatically self-compensating for operation after an unexpected shunt occurs across the track in a monitored section.

SUMMARY OF THE INVENTION

Briefly described, the invention comprises a system capable of responding to variations in the lumped impedance value of the track caused by the moving shunt affect of an approaching train, and the system is operable over a wide range of dynamic track ballast conditions by virtue of the wide window between high and low track signal voltages during which the system is accurately responsive to approaching train speed and distance. The system includes a transmitter which provides to a track a pulse modulated AC carrier wave signal regulated by an automatic gain control, which is responsive to a control signal that is proportional to the track voltage or current, the former making the system accurately responsive to approach speed and the latter making the system highly sensitive. The current of the signal applied to the track is monitored in a track power monitor that latches up the system to produce its system output signal when the track power is below a minimum level. A receiver tied to the track receives the track signal and includes a motion detecting portion responsive to changes in the track signal effected by an approaching train to detect the same at a time depending on speed and approach distance from the track island defined between the respective transmitter and receiver track tie points. The system output signal may be used to pick up or to drop a signal relay or to control a further apparatus, such as a computer signalling system or the like.

A broken rail detector detects broken rails in the monitored track section or approach. High and low signal detectors respond to track signal voltages above and below the voltage limits defining a window or range of suitable track signals for effective system operation, and the low signal detector may back up the motion detecting portion in the event a train has moved to a location within an approach such that the track signal voltage drops below its minimum level before train motion has been detected. Also, a firm latch up of the system occurs whenever a broken rail or a high or no track signal is detected.

In order to reduce ring-by time required for recovery of the system and the signal relay as soon as possible after the train leaves the track island, a further automatic gain control in the receiver appreciably increases the gain in the motion detecting portion as a train enters the island and maintains such increased gain until shortly after the train has left the island completely. Moreover, a time delay lock out circuit maintains production of the system output signal indicative of an approaching train whenever the motion of a train has been detected and the track signal voltage has not yet dropped below a predetermined low signal level. Additionally, a bypass circuit for the low signal detector permits effective system operation even after an unexpected shunt occurs across the track within a monitored track section external of the track island. An automatic pulse height control circuit responsive to the motion detecting portion controls the sensitivity of the system by varying the magnitude of the pulses modulating the AC carrier wave signal.

By AC coupling respective circuit portions to each other the railway system is substantially operable in a mode such that failure of a circuit portion will cause the system safely to produce its system output signal indicative of an approaching train. Therefore, it is intended that for the most part a foreseeable uncompensatable failure of an element or a signal of the railway signal system usually will result in production of the system output signal, for example, a zero voltage, that permits a railway signal relay to drop, which releases protective gates, energizes an indicator light, or the like at a grade crossing.

With the foregoing in mind, it is a primary object of the invention to detect a train on a track.

Another object of the invention is to provide an indication of a train approaching a location on a track within a safe time before arrival at such location.

An additional object of the invention is to monitor the power level of a track signal transmitted in a railroad track.

A further object of the invention is to latch up a railway signal system to produce an output signal indicative, for example, of an approaching train, whenever a broken rail, uncompensatable track ballst or defective track signal condition is detected.

Still another object of the invention is to lock out briefly a railway signal system after the motion of an approaching train has been detected to maintain an output indication of such detection.

Still an additional object of the invention is to reduce the ring-by time required for the recovery of a railway signal system when a train leaves a protected track island.

Still a further object of the invention is to enhance the fail-safe operation of a railway signal system.

Even an additional object of the invention is to detect an approaching train accurately with respect to its speed to avoid excessive gate down time and the like.

Even another object of the invention is to maintain the operability of a railway signal system to detect an approaching train on a track after an unexpected shunt occurs across a monitored section of the track.

These and other objects and advantages of the present invention will become more apparent as the following description proceeds.

To the accomplishment of the foregoing and related ends the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

In the preferred embodiment of the invention, a signal relay is driven by a two-stage circuit that includes, first, a relay drive oscillator, which is responsive to the output of the motion detecting portion of the system, and, second, a voltage follower amplifier responsive to the output of the relay drive oscillator and having input Vcc power provided from other circuit portions conditions, and the like. Therefore, a failure in one of the circuits of the railway signal system will usually effect elimination of the Vcc power to the voltage follower amplifier in the relay drive and will cause the relay to be dropped.

BRIEF DESCRIPTION OF THE DRAWINGS

In the annexed drawings:

FIGS. 2A, 2B and 2C are detailed schematic electric circuit diagrams, partially in block form, of respective portions of the railway signal system of the invention depicted in FIG. 1;

FIG. 3 is a graph of an interrupted or pulse modulated AC carrier wave signal generated by the transmitter of the railway signal system for application to the track as the track signal; and FIG. 4 is a graph of a control signal developed in the motion detecting portion of the railway signal system, referred to below as the shaped $E_c$ signal, which includes a DC voltage with an impressed AC pulse, both being proportionally representative of the track signal received by the receiver.

DESCRIPTION OF THE PREFERRED EMBODIMENT

Figure 1:
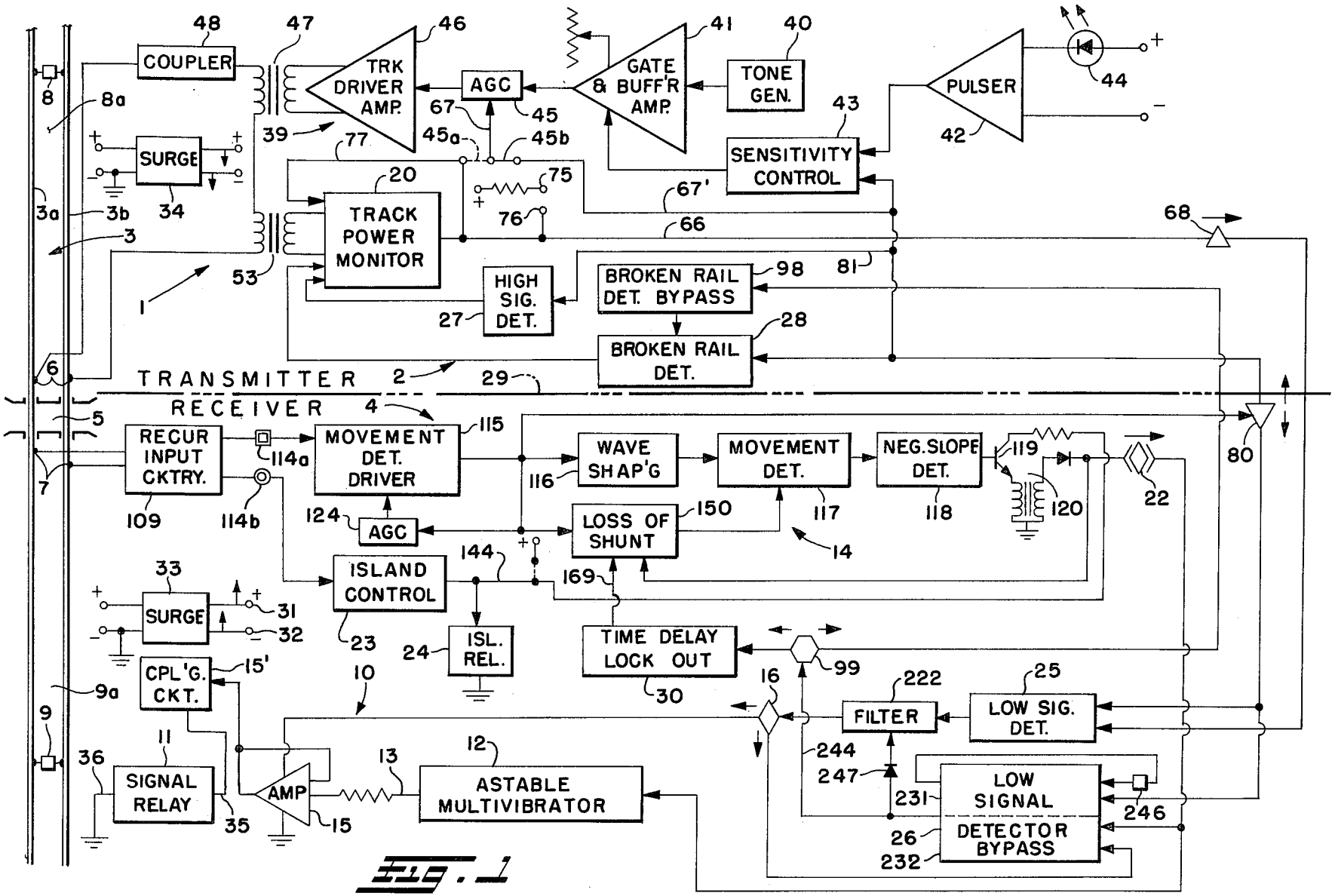
FIG. 1 is a schematic electric circuit diagram, substantially in block form, of the railway signal system of the invention.
Figures 2A, 3, 4:
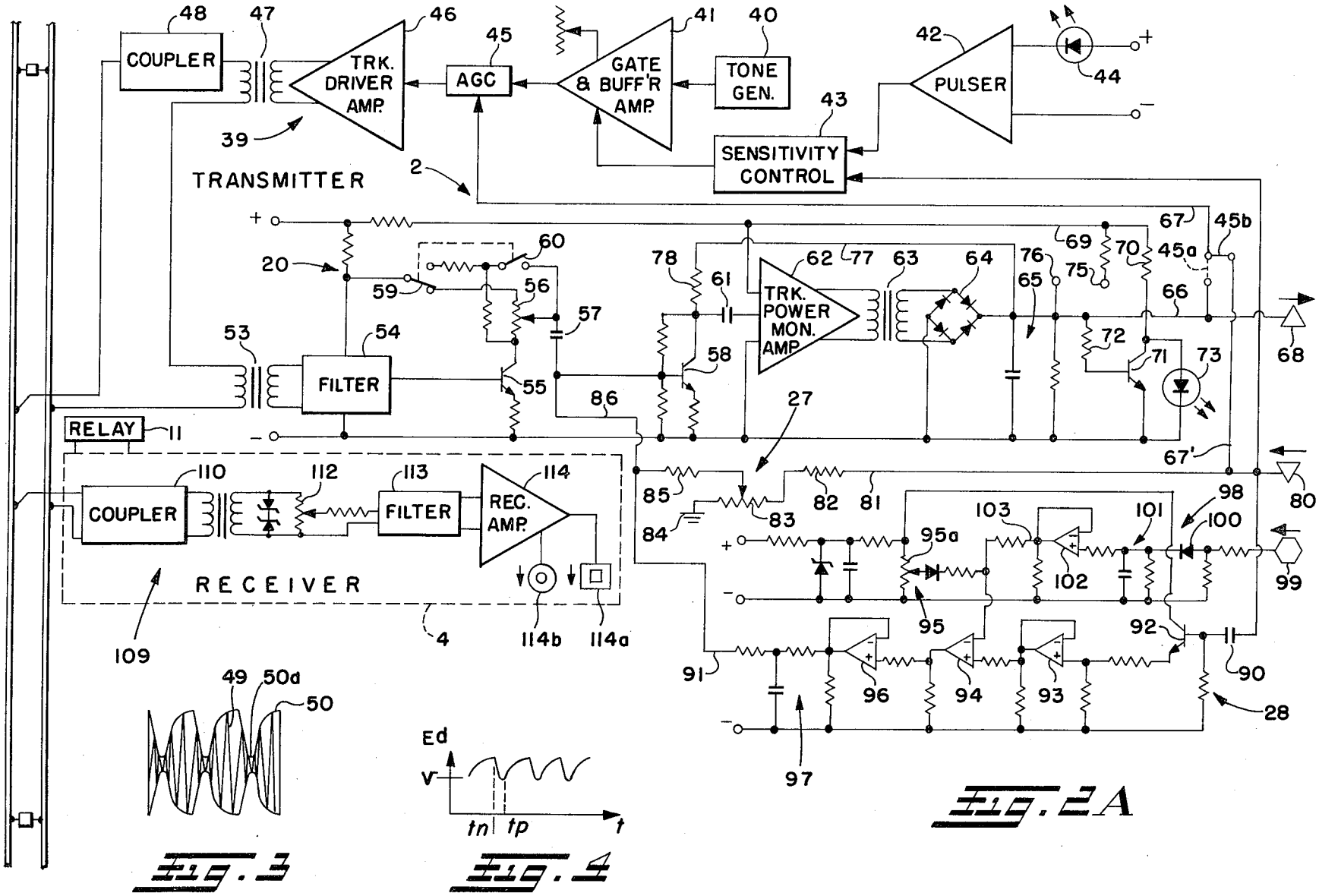
Figure 2B:
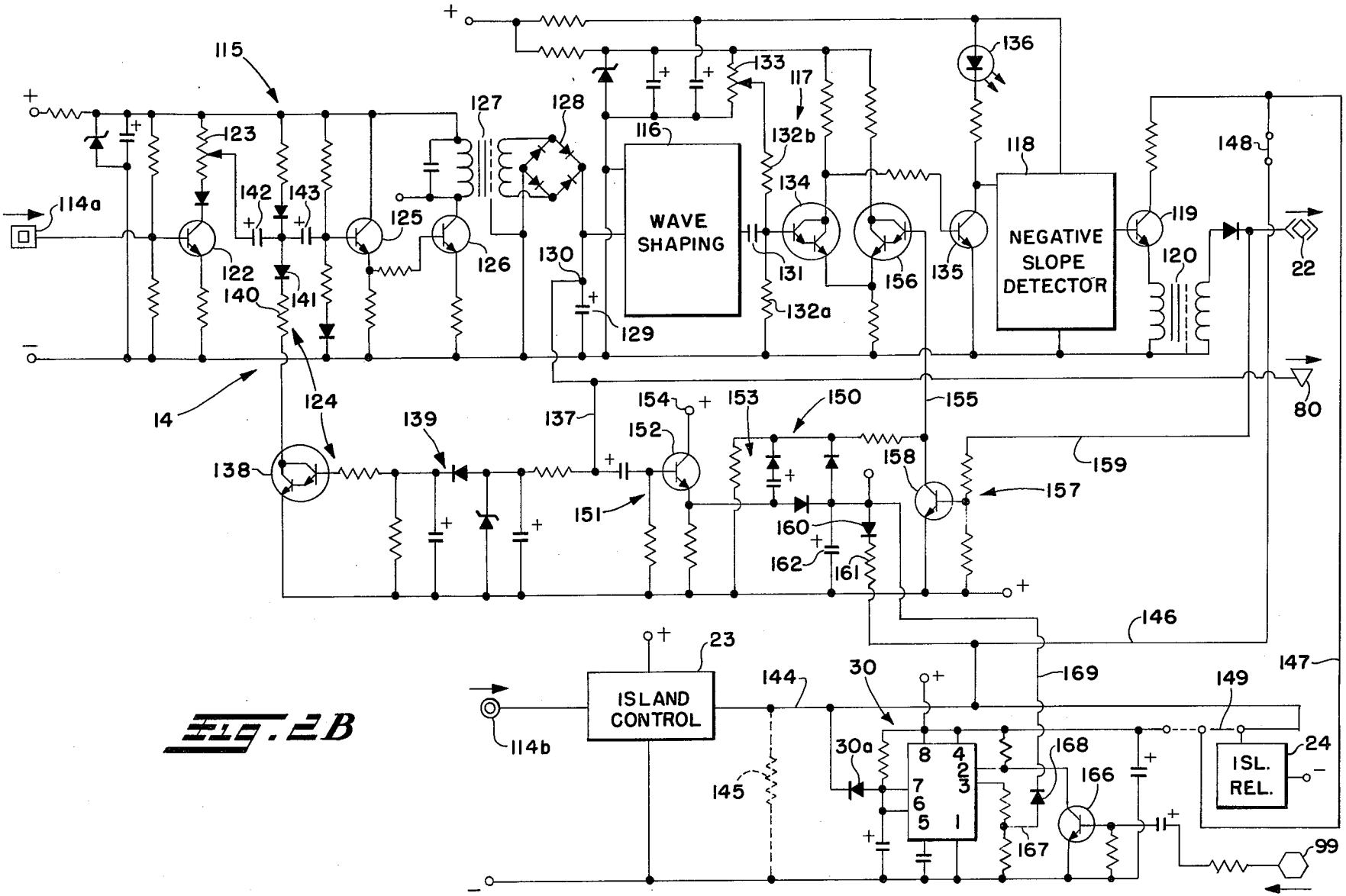
Figure 6B:
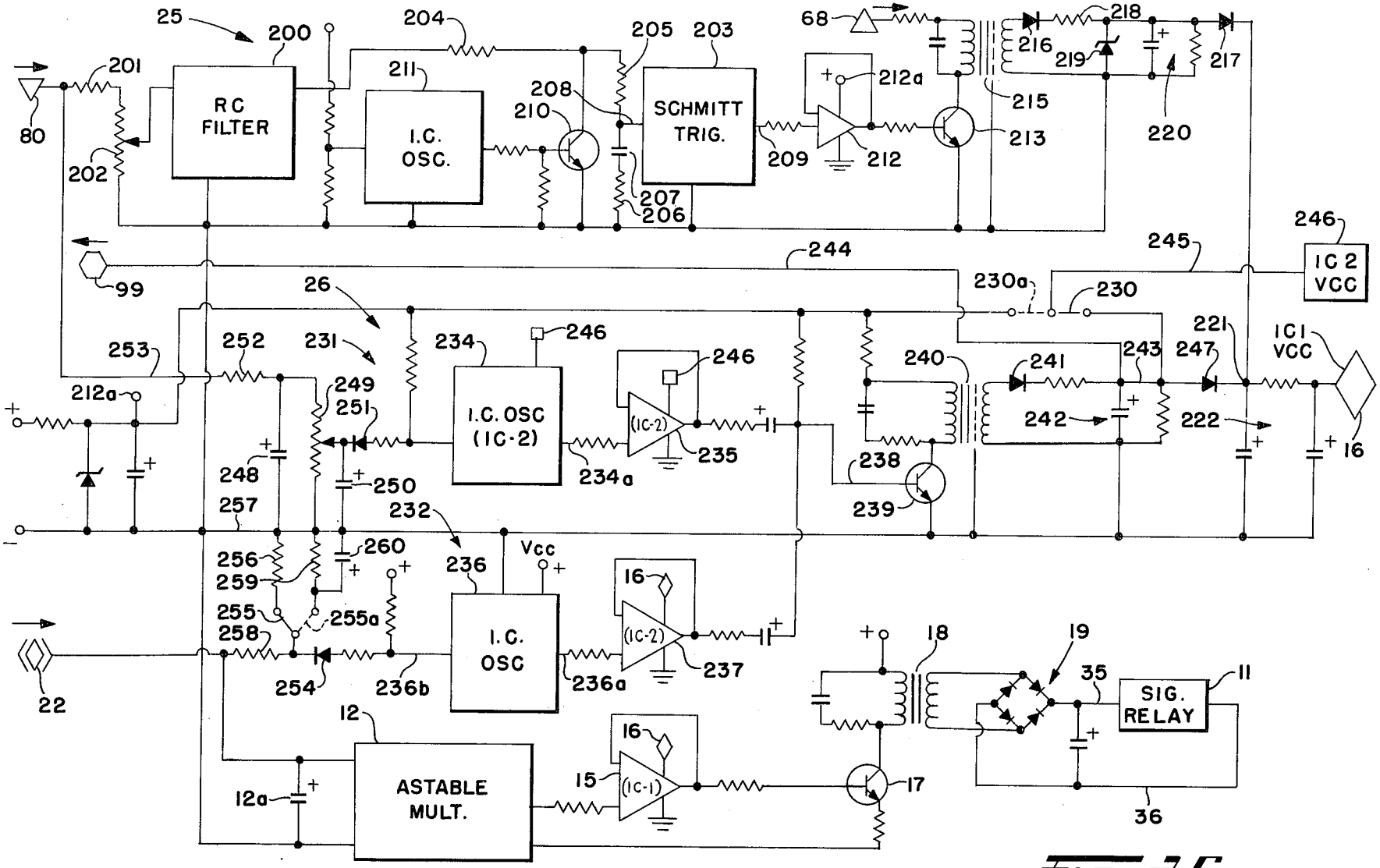

In referring to the drawings now, like reference numerals are used to designate like parts in the several figures. It is also to be understood that FIG. 1 depicts the entire railway signal system, whereas FIGS. 2A, 2B and 2C show respective portions thereof. Using the railway signal system 1 of the instant invention an AC electric signal generated in the transmitter 2 is applied to the rails 3*a*, 3*b* of a track 3 as a track signal, and a receiver 4 connected to the track normally receives the track signal and responds to changes therein caused for example, by the change in the lumped impedance of the track ballast by the moving shunt of a train approaching the island 5 defined between the transmitter and receiver tie points or connections 6, 7 to the track. The track signal is capable of traveling through the track in both directions from the island over approximatley 1 or more miles, depending on the track signal frequency, and in order to establish respective approaches to the island 5 of predetermined lengths beginning of approach shunts 8, 9, which may be of the filtering of purely conductive type, are connected across the track rails at the beginning of each approach 8*a*, 9*a*, for example, one half to one mile away from the island, depending on the expected speeds of approaching trains, accessibility to remote portions of the track, track signal frequency, and the like.

All of the circuit portions of the railway signal system 1 operate and/or cooperate to provide power to an output circuit portion 10, which will pick up a signal relay 11, for example, that holds up a crossing gate to allow motorists to drive through a grade crossing. If power is interrupted to any part of the output circuit portion, the signal relay will be dropped and the crossing gate will be released. The output circuit portion 10 includes an astable multivibrator oscillator 12, which produces an AC output signal on line 13 when supplied with power from the motion detecting portion 14 of the system, and a voltage follower amplifier 15, which amplifies the multivibrator output signal when Vcc power is supplied at the terminal 16 from the various signal monitoring portions of the system. The output of the voltage follower amplifier 15 is used to drive a power transistor amplifier 17, which energizes a pulse transformer 18, and the output from the latter is rectified and filtered at 19 with the resulting system output signal being used to energize or to pick up the signal relay 11. The elements 17 through 19 shown in detail in FIG. 2C are represented in FIG. 1 by the coupling circuit box 15'. If power is interrupted to either ther astable multivibrator 12 or the voltage follower amplifier 15, the power transistor amplifier 17 will not drive the pulse transformer 18, and the resulting zero system output signal will allow the signal relay to be de-energized or dropped.

The transmitter 2 generates an interrupted or pulse modulated AC carrier wave signal at an accurately regulated frequency. That signal is closely monitored by a track power monitor 20, which normally provides a power or driving signal to a portion of the receiver 4 when the track signal power is satisfactory. An automatic gain control 45 normally maintains the track signal at a relatively constant power level in response to the $E_d$ control signal voltage proportional to track signal voltage, although the track ballast conditions may vary over a fairly wide range; the automatic gain control 45 alternatively may be responsive to the track signal current monitored by the track power monitor 20, as will be described in more detail below. In the receiver 4 a motion detecting portion 14 produces a motion detecting signal at the bracketed diamond terminal 223 representing whether or not the motion of an approaching train has been detected in an approach, and is island control portion 23 backs up the motion detecting portion to energize a separate island relay 24, when used, upon occurrence of a train is the island 5. Moreover, several signal monitoring portions of the system 1 include a low signal detector 25 and a low signal detector bypass 26 in the receiver 4 and a high signal detector 27 and a broken rail detector 28, which may be located in the transmitter 2, as shown, for example, in FIG. 1 where the heavy broken line 29 divides the tramitter and receiver.

It is, of course, desirable and an important criterion of the invention that the crossing gates at a protected railroad grade crossing be down for a safe and minimum amount of time to prevent accidents. The railway signal system 1 of the invention automatically correlates train approach speed and distance from the protected island 5 at the grade crossing, or the like, for most efficiently meeting such criterion. Moreover, in the receiver 4 a further automatic gain control increases the gain of the motion detecting portion 14 as a train enters the island and maintains the increased gain until shortly after the train has left the island completely to reduce the ring-by time required for recovery of the system and pick up of the signal relay and the crossing gates.

Since it is possible that a small amount of the track signal may travel beyond the respective beginning of approach shunts, a rapidly approaching train will act in parallel with one of those shunts to cause an attenuation characteristic of the track signal such that motion may be detected beyond the shunt and lost for a period of time after the train enters the approach within the shunt. Therefore, a delay circuit 30 effects a firm lock out of the railway signal system 1 to maintain the signal relay dropped for a period of time after the motion of an approaching train has been detected, provided that a low signal has not been detected.

The invention will be described in detail hereinafter with specific reference to FIGS. 2A, 2B, and 2C, the corresponding elements being found and designated in the overall system block diagram of FIG. 1. The railway signal system 1 receives DC input power from a DC power supply coupled to a pair of input terminals 31, 32 (FIG. 1), which terminals are connected to a pair of surge protection circuits 33, 34 used for providing DC power to illustrated terminals labels with positive or negative signs in the transmitter 2 and receiver 4, respectively. The railway signal system 1 will provide either a first positive or a second zero output signal on the lines 35, 36 to the signal relay 11, the first energizing or picking up the relay that, for example, maintains the crossing gate in a raised conditions, and the second de-energizing or dropping the relay that, for example, allows the crossing gate to be dropped to protect the island 5 from interference between automotive and locomotive traffic. As mentioned above, however, it is also to be understood that the railway signal system may be used in conjunction with a block signal control or for other remote control of the track section with or without the aid of a computer.

THE TRANSMITTER

The track signal generating portion 39 in the transmitter 2 includes a tone generator 40, which generates an AC carrier wave signal, for example, using a mechanical reed oscillator with an amplifier output stage. The AC carrier wave signal is combined in a gate and buffer amplifier 41, which may include one or more amplifier and emitter follower stages, with a modulating signal from a pulser 42 and a sensitivity control 43. The pulser 42 may be, for example, in the form of a conventional unijunction transistor oscillator circuit that operates a diode gate and has in one input a light emitting diode 44, which is pulsed at a rate determined by the frequency of the AC output signal generated by the pulser 42. The amplitude of the pulsing AC signal output from the pulser 42 is determined by the sensitivity control 43, which may include one or more amplifier and/or gate circuits responsive to the $E_d$ voltage in order to determine the percent modulation of the AC carrier wave signal. The output from gate and buffer amplifier 41, which is in the form of the interrupted or modulated AC carrier wave signal, is applied via an automatic gain control 45 that includes a power control gate and a pair of isolation capacitors to a track driver amplifier 46 and from the latter via a coupling transformer 47 and a coupler 48, which may include impedance matching and/or surge protection circuits, to the tie point 6 for coupling the modulated AC carrier wave signal to the track 3 as the track signal. The elements 40 through 48 are described in my above-identified U.S. patent application.

When the jumpers 45*a*, 45*b* are connected and opened, respectively, the automatic gain control 45 is reponsive to track signal current, as detected by the track power monitor 20, and it has been found that this arrangement provides high sensitivity in the system 1 for detection of trains at very remote distances say on a 3,000 to 4,000 foot approach. However, it has also been found that by making the control 45 responsive to track voltage, as reflected in the $E_d$ voltage, by connecting and opening, respectively, the jumpers 45*b* and 45*a*, the system 1 becomes very accurately responsive to train approach speed. This latter arrangement is especially desirable on bad, e.g. rusty, track, and also has the advantage of minimizing the nuisance of premature dropping of the crossing gate.

The wave form of the track signal is illustrated in FIG. 3 having a high frequency portion 49 that is, in effect, the AC carrier wave signal developed by the tone generator 40, which signal falls within the envelope 50 that is effectively generated by the pulser 42.

The depth of each of the valleys 50*a* of the envelope is determined by the sensitivity control 43 and is representative of the percent modulation of the AC carrier wave signal.

The track power monitor portion 20 monitors the current of the signal applied to the track via a transformer 53, which has its secondary coupled via an electro-mechanical reed oscillator filter 54 to several amplifier stages as described in my above-identified U.S. patent application. In the track power monitor portion 20 the output from the filter 54 is, more particularly, provided at the collector of the transistor 55, which is connected normally via an adjustable potentiometer 56 and coupling capacitor 57 to the base input of a transistor amplifier 58. The potentiometer 56 effectively sets the gain of the transistor amplifier 58 to determine the output voltage at the collector of the latter; however, if the ganged switches 59, 60 are adjusted to their alternate positions, not shown, the gain of the transistor amplifier 58 becomes fixed for testing purposes. The collector output of the transistor 58 is connected via a coupling capacitor 61 to the track power control amplifier 62, which has its output transformed, rectified and filtered by a transformer 63, bridge rectifier 64 and RC filter 65 so that the voltage level of the signal appearing on the line 66 is normally proportionally representative of the voltage of the signal applied to the track.

The line 66 is coupled at an upwardly facing triangular terminal 68 to a power input of the low signal detector 25, illustrated in FIG. 2C, to supply power for operation of the latter when the transmitter is generating the track signal and the track power monitor is fully operational. The arrow convention at the terminal 68 indicates a signal leaving that terminal for use at another. A line 69 from a positive DC power terminal of the transmitter provides via a resistor 70 collector power to a transistor 71 which has its base coupled by a resistor 72 to the line 66. Across the emitter and collector of the transistor 71 is connected a light emitting diode 73, which is extinguished whenever a positive signal appears on the line 66 and is illustrated when the voltage on line 66 goes to zero to therefore indicate whether the signal generating portion 39 and track power monitor 20 are fully and properly operational.

Assuming that the track signal generating portion 39 is operating properly to produce the modulated AC carrier wave signal a brief short circuiting of the terminals 75, 76 will provide power via the line 77 and resistor 78 to the collector of the transistor amplifier 58. The transistor amplifier 58 then produces an AC output signal that is amplified by the track power monitor amplifier 62, and a voltage is then supplied on the line 66.

If it is desired to test the voltage of the track signal, the switches 59, 60 may be adjusted to their alternate positions, and the voltage appearing at the terminal 76 then will be a known direct proportion of an applied voltage to the track. Normally, however, when the switches 59, 60 are in their positions as shown, the gain of the transistor amplifier 58 and the overall track power monitor portion 20 may be adjusted by the potentiometer 56. Thus, for example, at the end of the Fall, when freezing conditions can be expected, the gain of the transistor amplifier 58 may be adjusted to a relatively low level, and an opposite adjustment may be made, for example, in mid-Spring when warmer and wetter weather and corresponding lower impedance ballast conditions are expected.

In order that the railway signal system 1 operate with maximum effectiveness and safety, it is desirable that the power level of the track signal fall within a predetermined window, the upper and lower limits of which are normally defined respectively by the high signal detector 27 and the low signal detector 25, which is shown in FIG. 2C. Although the automatic gain control 45 is operable within predetermined limits to maintain the track signal power level within that window in response to the $E_d$ voltage supplied on the line 67 via line 67′, a radical change in ballast conditions may, for example, cause the track signal voltage to exceed the upper limit of the window regardless of the affect of the automatic gain control 45. Thus, the $E_d$ voltage developed in the motion detecting portion 14, shown in FIG. 2B, will exceed the upper limit voltage level of its corresponding window.

The high signal detector 27, positioned for physical convenience in the transmitter, is connected by the line 81 to monitor the $E_d$ signal from the motion detecting portion 14 via the downwardly facing triangular input terminal 80. In the high signal detector 27 a resistor 82 and potentiometer 83 are series connected between the line 81 and a ground or negative voltage connection 84. The adjustable wiper arm of the potentiometer 83 is connected by a resistor 85 and the line 86 to the base of the transistor amplifier 58, and the setting of the potentiometer 83 determines the upper limit of the mentioned window. If the $E_d$ voltage exceeds that set on the potentiometer 83, saturation of the transistor amplifier 58 will be effected, and cut off of any AC output from the track power control amplifier 62 will occur. Therefore, the line 66 will not receive any power; no power will be received at the power input to the low signal detector 25 via upwardly facing triangular terminal 68; and as a result the second or zero system output signal will be produced dropping the signal relay, as will be described in more detail below.

Moreover, once power to the line 66 is discontinued, the track power control 20 cannot be restarted unless the terminals 75, 76 are briefly short circuited in the manner described above. Also, whenever power is removed from the line 66, the transistor 71 will become non-conductive and the light emitting diode 73 will be energized to emit light indicating, for example, that the track signal voltage had exceeded its upper limit.

The broken rail detector 28 is connected via a coupling capacitor 90 to the downwardly facing triangular input terminal 80 to float with or to follow the $E_d$ voltage. If the $E_d$ voltage level were to rise substantially instantaneously more than approximately two to four volts before the motion of an approaching train has been detected by the motion detecting portion 14, the broken rail detector will produce a signal at its output 91, which is coupled to the line 86, to saturate the transistor amplifier 58 and effect a zero output signal on the line 66 in the track power control 20. The required 2 or more volt rise in the $E_d$ voltage level would usually be caused by the occurrence of a broken rail in the monitored section of track, and the coupling capacitor 90 normally blocks slow $E_d$ voltage level changes caused by an approaching train or slowly varying ballast conditions.

The broken rail detector 28 includes an input transistor 92 having its base coupled to receive any signal passing the coupling capacitor 90. The emitter output from the transistor 92 is coupled to one input of a conventional voltage follower amplifier 93, which provides electrical isolation and avoids loading of other circuits in the system 1. The voltage follower amplifier 93 provides one input to a conventional amplifier threshold detector 94, the other input of which is connected to a bias circuit 95, which is adjustable by the potentiometer 95*a* to determine the required voltage rise on the coupling capacitor 90 in order to obtain an output signal from the amplifier threshold detector 94. The amplifier threshold detector 94 is connected to another voltage follower amplifier 96 for further isolation, and the output of the latter is supplied via an RC filter 97 to the line 91 as the ouput signal of the broken rail detector 28.

A disable circuit 98 for the broken rail detector 28 receives a trigger input signal at the hexagonal input terminal 99, which is coupled to the low signal detector bypass 26, shown in FIG. 2C. As will be described in more detail below, the low signal detector bypass produces such a trigger signal when the motion detecting portion 14 detects the motion of an approaching train before the low signal detector has detected a low track signal. That trigger signal is provided via the hexagonal terminal 99, a diode 100 and an RC filter 101 to the input of a voltage follower amplifier 102. When no trigger signal is received at the hexagonal input terminal 99, the output 103 from the voltage follower amplifier 102 is effectively at zero and has no affect on the broken rail detector 28. However, when a trigger signal is received at the hexagonal input terminal 99, the output 103 of the voltage follower amplifier 102 rises sharply and biases the amplifier threshold detector 94 to an off condition so that no output can be produced from the latter, thus disabling the broken rail detector 28, unless the $E_d$ voltage exceeds a maximum level of, for example, 50 volts.

It should now be understood that the high signal detector 27 detects a high $E_d$ and corresponding track signal, say, for example in one embodiment, above approximately 40 or 50 volts, which may be due to an uncompensatable track ballast condition or a broken rail within the section of monitored track. The broken rail detector 28, on the other hand, detects a broken rail as soon as the rail is broken, whether caused by a train on the track, a radical temperature change, or the like, assuming that the motion of an approaching train has not been detected by the railway signal system 1. As a safety feature of the invention, whenever a high signal or broken rail is detected, the output line 66 of the track power monitor 20 goes to zero potential and is latched up at that condition until a service person briefly connects the terminals 75, 76. Therefore, if a high signal or broken rail is once detected, the system 1 will latch up dropping the signal relay 11, as will be described below; the inspecting service person will observe illumination of the light emitting diode 73, and he will then know to check the monitored track for a broken rail or to adjust the system for a changed ballast condition.

THE RECEIVER

The receiver input circuitry 109 includes a coupler 110, which may comprise, for example, impedance matching, surge protection, and/or the like circuits, a coupling transformer 111, a potentiometer 112, a highly selective input filter 113 tuned to the frequency of the AC carrier wave signal, and a receiver amplifier 114. The receiver amplifier effectively serves a pre-amplifying function and provides at its concentric squares output terminal 114*a* an AC control signal that controls the motion detecting portion 14 and at its concentric circles output terminal 114*b* and AC signal that controls the island control portion 23.

Referring now to FIG. 2B, the motion detecting portion 14 includes a movement detector driver 115, preferably in the form of a several stage amplifier having an adjustable gain, a wave shaping circuit 116, a movement detector 117, and a negative slope detector 118, the output from which is provided to an amplifying power transistor 119 which drives a coupling transformer 120. As long as the motion of an approaching train has not been detected and power is supplied to the collector of the transistor 119, the secondary of the transformer 120 will provide a positive output signal at the bracketed diamond terminal 22. Moreover, such a positive signal is required in order to maintain the capacitor 12*a* charged to supply power to energize the stable multivibrator oscillator 12 (FIGS. 1 anad 2C); otherwise the signal relay 11 will be dropped. The voltage at the bracketed diamond terminal 22 will be effectively zero or slightly negative whenever approaching train motion has been detected or collector power to the transistor 119 is interrupted.

More particularly now, the movement detector driver includes a first transistor amplifier stage 122, which amplifies the signal received at the concentric square input terminal 114*a* from the receiver amplifier 114. The collector output from the transistor amplifier 122 is provided via a potentiometer 123 for manual gain adjustment of the movement detector driver and an automatic gain control arrangement 124 for automatic control of the movement detector driver gain to a second transistor stage 125, which is connected in an emitter follower configuration. The output of the transistor 125 drives a power transistor amplifier 126, which energizes the primary of a transformer 127, and the signal appearing at the secondary of the transformer 127 is full wave rectified by a bridge rectifier 128 and filtered by a capacitor 129 and to an extent by the wave shaping circuit 116. The signal appearing at the node 130 is the pre-shaped $E_d$ signal, i.e. prior to full shaping thereof by the wave shaping circuit 116, the output from which is the shaped $E_d$ signal shown in FIG. 4.

The shaped $E_d$ signal is supplied to the blocking or differentiating capacitor 131, which is coupled together with the resistors 132*a*, 132*b* and the potentiometer 133 as the base bias circuit of a Darlington pair transistor amplifier 134, which constitutes the active element of the movement detector 117. The collector output from the transistor amplifier 134 is coupled to a buffering transistor 135, which drives the negative slope detector 118. Each time the buffering transistor 135 is driven to conduction to drive the negative slope detector, the light emitting diode 136 is illuminated to indicate operation of the motion detecting portion 14.

The operation of the motion detecting portion 14 is described in detail in my above-identified U.S. patent and copending U.S. patent application. Briefly described, however, in operation of the motion detecting portion 14 the AC signal received at the concentric square input terminal 114*a* from the receiver amplifier 114 is amplified in the movement detector driver 115, and the output therefrom is transformed, rectified, filtered and shaped before being provided as the shaped $E_d$ signal to the capacitor 131. In an exemplary embodiment of the invention, when no train is within the beginning of approach shunts 8, 9 on the track 3 or otherwise within the range of track through which the track signal is effectively transmitted, the shaped $E_d$ signal preferably has a 40 volt DC level v and a proportional 2.5 volt peak-to-peak impressed pulse, as is illustrated, for example, in FIG. 4. When a train is at a certain location between a beginning of approach shunt and the island 5, effecting a shunt across the tracks and reducing the effective track ballast seen by the transmitter 2 and track signal received at the receiver 8, the $E_d$ signal is reduced by an amount depending on the distance into the approach, for example, to a 20 volt DC level and a 1.5 volt pulse.

The differentiating capacitor 131 normally blocks the DC part of the $E_d$ signal and provides through the pulses impressed on such DC part a constant self-checking of the railway signal system 1, for example, at a rate of approximately 5 times per second, depending on the frequency of the pulses. The capacitor 131 may be considered in a zero or charged state, i.e. it charges back to zero state condition at a constant charging rate. Thus, each time an $E_d$ pulse goes in a negative direction, e.g. beginning at time $t_n$ in FIG. 4, simulated motion is detected by the movement detector 117 and the amplifier 134 is cut off; and as the pulse recovers in the positive direction, e.g. beginning at time *tp*, the capacitor 131 recharges and the amplifier 134 conducts. When a continued slow drop of the DC part of the Ed signal occurs, for example, due to a slowly approaching $E_d$ far from the island 5, the differentiating capacitor 131 maintains itself only a slight amount away from the zero state, drawing very little current from its recharging circuit, which is the base biasing network of the amplifier 134 and includes the potentiometer 133 and resistors 132*a*, 132*b*, and the $E_d$ pulses will effect an AC output from such amplifier.

The train on the track 3 within a beginning of approach shunt and traveling toward the island 5 is a traveling shunt that reduces the track signal as well as the preshaped $E_d$ signal at the node 130, such signal reductions being generally non-linear with respect to train distance from the island due to the non-linearity of the accumulated track ballast impedance in the approach. Although it has been found, for example, that signals having frequencies from 20 to 65 Hz exhibit some semblance of linearity of attenuation over a given length of track, higher frequency signals, say from 300 to 3000 Hz are substantially non-linear over the entire approach.

In the mentioned embodiment when the DC part of the shaped $E_d$ signal is at 40 volts with a 2.5 volts pulse, an approaching train causing a drop of the $E_d$ signal in excess of approximately 0.4 volt per second will bias the amplifier 134 to cut off preventing it from passing the pulses through the succeeding stages of the motion detecting portion 14 with the result of no positive signal being provided to the bracketed diamond output terminal 22; and, therefore, the signal relay 11 will drop. Similarly, when the shaped $E_d$ signal is at 20 volts with a 1.25 volt pulse, a 0.2 volt per second drop in the DC part will maintain the amplifier 134 cut off. Once the amplifier 134 is cut off, the traveling shunt affect of the approaching train maintains the amplifier 134 cut off due to a continuing $E_d$ drop at a rate faster than the pulses effectively rise, and since the capacitor 131 cannot recharge instanteously the base of the amplifier 134 is effectively held negative.

The railway signal system 1 becomes increasingly more sensitive to $E_d$ drop as the train approaches the island because the $E_d$ pulses require less of an overall $E_d$ drop to bias the amplifier 134 cut off. Moreover, since the track ballast impedance is usually seen as a non-linear impedance, a train 3000 feet from the island must effect, for example, a reduction of the $E_d$ signal at a rate of approximately 0.4 volt per second for the motion detecting portion 14 to detect the motion of such approaching train; whereas a train only several hundred feet from the island need only effect a reduction of the $E_d$ signal at a rate of approximately 0.011 volt per second for detection of the motion thereof. An AC output signal from the movement detector 117 will operate through the buffering transistor 135 to cut off the normally saturated active transistor in the negative slope detector 118 when such AC output signal is in its negatively sloped portion, and the output from the negative slope detector is, therefore, generally in the form of a square wave that drives the power transistor amplifier 119 and ultimately the transformer 120. Since the negative slope detector is operated alternately at saturation and at cut off, it is relatively immune to noise and provides circuit isolation and uniform regulation of the positive signal appearing at the bracketed diamond terminal 22.

The automatic gain control arrangement 124 monitors the pre-shaped $E_d$ voltage level at the node 130 by a connection 137. In the automatic gain control arrangement 124 a high gain Darlington pair transistor amplifier 138 is normally biased to full conduction or saturation by a Zener diode and RC filter circuit 139 when the $E_d$ voltage at the node 130 exceeds a predetermined level of, for example 5 volts to reduce the gain in the movement detector driver 115 to a minimum by bleeding off or attenuating part of the output signal from the transistor 122 via a resistor 140 and a diode 141, which are coupled to the junction of a pair of isolation capacitors 142, 143. On the other hand, when the $E_d$ voltage level drops below the predetermined level, the Darlington pair transistor amplifier 138 is no longer at saturation, and the gain of the movement detector driver 115 is substantially increased.

As described above, the sensitivity of the railway signal system 1 to the motion of an approaching train appreciably increases with increased proximity of the train to the island. In fact, in one embodiment of the invention it has been found that when the $E_d$ voltage has dropped to approximately 5 volts, the sensitivity of the system to detect the motion of an approaching train is increased to approximately 27 times the sensitivity thereof when the $E_d$ voltage is at the normal maximum 40 volt level. Therefore, if an approaching train has caused the $E_d$ signal voltage to drop to a level such that the Darlington pair transistor amplifier 138 is no longer at saturation and has no further attenuation affect, the sensitivity of the motion dectecting portion 14 will still be adequate to detect safely the motion of an approaching train.

Normally, the $E_d$ voltage at the node 130 should be on the order of at least one volt in order to effect production of a positive output signal at the bracketed diamond output terminal 22 so as to pick up the signal relay 11. In using the automatic gain control arrangement 124, when a train leaves the island 5, the $E_d$ signal voltage at the node 130 will reach 1 volt to pick up signal relay 11 usually by the time the rear wheels of the last train car have moved from one half to one rail length, on the order of 18½ to 37 feet away from the island, thus reducing ring-by time to a minimum.

The island control portion 23 includes, for example, one or more amplifier stages, a transformer, rectifiers, filters, and the like, as shown in detail, for example, in my above-identified U.S patent. The island control receives an input signal at the concentric circle terminal 114*b* from the receiver amplifier 114 and provides on its output line 144 a DC voltage whenever the receiver 4 receives a track signal, i.e., when no train is present in the island 5. However, if a train is present in the island causing no track signal to be received at the receiver, the output line 144 effectively goes to ground potential when a train is present in the island. The output line 144 is connected to the island relay 24 to pick up or to drop the same depending on whether or not a train is present in the island 5. For impedance matching purposes a resistor 145 equal to the resistive impedance of the island relay 25 may be coupled at the output of the island control 23, if the island relay is not used.

Moreover, as a further safety feature the island control output line 144 is connected by lines 146, 147 and by jumpers 148, 149 to the power transistor amplifier 119 at the output of the motion detecting portion 14. Therefore, if the jumpers are connected as shown and the island control portion 23 has detected a train in the island 5, no collector power will be supplied to the transistor 119, and the voltage at the bracketed diamond output terminal 22 will be effectively zero dropping or maintaining dropped the signal relay 11. If the track is relatively noisy with other signals, it may be desired to supply a positive DC power signal to the transistor by changing the jumper 149 to its dotted position and removing the jumper 148.

A loss of shunt detector 150, described in detail in my copending U.S patent application and U.S. patent, receives the $E_d$ signal as an input signal from the line 137 through an RC circuit 151, which is coupled to control a transistor 152 that may energize a timing circuit 153 with power from the positive terminal 154. The output line 155 from the timing circuit may provide a signal from the latter to effect conduction in a further Darlington pair transistor amplifier 156, which when energized will raise the potential at the emitter of the Darlington pair transistor amplifier 134 in the movement detector in order to assure cut off of the same. A disabling circuit 157 for the loss of shunt detector 150 includes a transistor 158 coupled by the line 159 to the rectified output of the secondary of the pulse transformer 120 to maintain the capacitors in the timing circuit 153 in a discharged condition as long as positive output signal appears at the bracketed diamond output terminal 22. Moreover, a connection from the timing circuit 153 via a diode 160 and a resistor 161 to the output line 144 of the island control portion 23 provides for discharge of the relatively larger capacitor 162 in the timing circuit when a train is detected in the island and the island control portion output goes to zero.

It is noted here that the loss of shunt detector 150 maintains motion detection in the movement detector 117 if a detected approaching train, for example, runs across a rusty rail, which briefly causes the $E_d$ voltage to rise but not above the 50 volt level at which the broken rail detector 28 would be operated to latch up the track power monitor 20. Therefore, before motion is detected a rapid, almost instantaneous, 2 volt or 50 $E_d$ voltage rise will cause the broken rail detector 28 to latch up the track power control 20; but if motion has been detected and the low signal detector 25 has not yet dropped out, as will be described below, the disable circiut 98 is triggered and prevents the broken rail detector from responding to $E_d$ voltage changes unless the $E_d$ voltage reaches 50 volts, thus allowing for effective operation of the loss of shunt detector 150. Moreover, if the bypass circuit 98 has not been triggered before a low signal has been detected by the low signal detector 25, then, again, a 2 volt rise in $E_d$ voltage will cause the broken rail detector 28 to latch up the track power monitor 20.

Due to the lumped impedance affect of the track ballast, beginning of approach shunt, and moving shunt of an approaching train outside a beginning of approach shunt, the motion of an approaching train sometimes may be detected when the train is still beyond the beginning of approach shunt; and after the forward wheels of the approaching train cross the beginning of approach shunt, motion detection may be lost briefly. The signal relay 11, therefore, may drop and recover unnecessarily, which may be a nuisance to drivers, pedestrians, and people living in proximity to the same and also might lead a driver, in particular, to the improper conclusion that the grade crossing protection device is defective and no train is approaching, possibly, then, resulting in an accident.

To avoid the above potential nuisance, the time delay circuit 30 provides for firm lock out of the railway signal system 1 whenever the motion of an approaching train is detected and the track signal voltage and corresponding $E_d$ voltage are above the low signal point. Upon occurrence of such conditions, a trigger signal will be received at the hexagonal input terminal 99 from the low signal detector bypass circuit 26, which effects conduction in the transistor 166 at the input of the time delay circuit 30. The transistor 166 then applies a negative gating signal to the time delay circuit 30, which is preferably a monostable multivibrator, causing the latter to produce a positive output signal at its output 167. This mentioned positive output signal is coupled via a diode 168 and line 169 to the timing circuit 153 in the loss of shunt detector 150 to effect charging of the capacitor 162, which will maintain conduction in the second Darlington pair transistor amplifier 156 and cut off of the first Darlingtion pair transistor amplifier 134 in the movement detector 117. Therefore, an effective zero voltage will appear at the bracketed diamond output terminal 22 indicative of detection of motion of an approaching train at least for the duration that the monostable multivibrator 30 maintains its positive output signal, for example, 15 to 20 seconds, thus maintaining the signal relay 11 deenergized for that period of time. If the approaching train has entered the island 5 before the multivibrator 30 times out, the latter will be reset rapidly by a discharge path provided through a diode 30*a* to the line 144, then at ground potential. Preferably the multivibrator 30 is in the form of an integrated circuit having a number of terminals and connections as shown for application of proper bias potentials and the like; the illustrated configuration is, of course, exemplary only, and other time delay devices with appropriate connections may be substituted for the shown device.

Turning now more particularly to FIG. 2C, the low signal detector 25 receives the pre-shaped $E_d$ signal as a control signal at the downwardly facing triangular input terminal 80. The $E_d$ control signal is applied to a conventional RC filter 200 via a resistor 201 and a potentiometer 202, which is adjustable to determine the low signal set point, i.e., the minimum voltage level of both the track signal and the proportional $E_d$ signal above which is within the mentioned voltage window at which the railway signal system 1 normally will operate effectively. The output from the RC filter 200 is coupled to a Schmitt trigger circuit 203 via a series circuit including resistors 204, 205, 206 and a capacitor 207, the Schmitt trigger circuit, of course, requiring that the voltage at its input 208 be at a predetermined level in order to obtaiin a signal at its output 209. The output signal from the RC filter 200 is substantially a DC signal that is modulated at the junction of the resistors 204, 205 by a modulating circuit that includes, for example, a transistor chopper 210 driven by an integrated circuit oscillator 211, such as an astable or free running multivibrator. The Schmitt trigger circuit 203, therefore, effectively monitors the $E_d$ signal voltage; if the $E_d$ voltage is above the low signal level set on the potentiometer 202, an AC output signal in the form of a square wave will be produced at the Schmitt trigger output 209 and if the $E_d$ voltage is below the low signal level, no AC signal will be provided at the output 209.

A voltage follower amplifier 212 coupled to the Schmitt trigger output 209 for isolation purposes drives a power transistor amplififer 213, which energizes a coupling transformer 215 upon receipt of an AC base input assuming power is supplied to the transformer via the upwardly facing triangular input terminal 68 from the track power control 20 (FIG. 2A). The amplifier 212 has a Vcc connection at terminal 212*a*. The secondary of the coupling transformer 215 is coupled by diodes 216, 217, a resistor 218, a zener diode 219 and an RC filter 220 to a nodal point 221 in order to provide at the latter a positive voltage whenever an AC signal is induced in the transformer secondary. Moreover, the positive signal that may occur at the nodal point 221 is filtered by an RC filter 222 and is then provided via the diamond-shape terminal 16 as the Vcc supply to the voltage follower amplifier 15 in the system output portion 10 as well as to a voltage follower amplifier 237 in the low signal detector bypass circuit 26. For convenience both amplifiers 15 and 237 may be on the same integrated circuit package denoted IC-1.

As described above, in order to energize the voltage follower amplifier 15 it is necessary to have a positive signal appear at the diamond-shape terminal 16 to provide the amplifier with Vcc power and such positive signal can only be achieved if a positive signal is supplied at the nodal point 221. Such positive signal may be supplied, for example, from the low signal detector 25 in the following manner. The potentiometer 202 is set at the low signal level, for example 24 volts, which requires that the pre-shaped $E_d$ signal be above that voltage for the Schmitt trigger circuit 203 to operate and to provide an AC output signal at its output 209. Then, if the track power control 20 is operative to supply a positive signal at the upwardly facing triangular terminal 68 to the primary winding of the coupling transformer 215, the power transistor amplifier 213 will drive the coupling transformer to induce a signal on its secondary. The induced signal is rectified, clipped, filtered and supplied at the nodal point 221. If no positive signal is received at the upwardly facing triangular terminal 68 from the track power monitor 20 or if the pre-shaped $E_d$ voltage is below that set on the potentiometer 202, the low signal detector will drop out and there will be no positive output signal supplied at the nodal point 221 from the low signal detector 25.

If it were desired to detect a train located a predetermined distance from the island 5 regardless of the train approach speed, for example, the potentiometer 202 would be set at a voltage level that would cause the low signal detector to drop out when the $E_d$ voltage was at a level that would occur when an approaching train was present on the track at the predetermined distance. The potentiometer 202 may be set to any desired level to adjust the mentioned voltage window over which the system 1 is operable effectively to detect the motion of an approaching train, as well as to adjust the predetermined distance from the island that an approaching train would be affirmatively detected regardless of approach speed. When using the railroad signal system 1 to protect a grade crossing of a track on which train cars or engines often stand proximate the island, for example at a railroad yard, the low signal detector 25 may be disbled by changing the normally closed connecton of a jumper 230 shown in solid line in FIG. 2C to the normally open dotted connection 230a for operation in a manner to be described in more detail below.

Referring now more particularly to the low signal detector bypass 26, the latter includes a first $E_d$ voltage level responsive portion generally indicated at 231, and a second portion generally indicated 232, which is directly responsive to the output of the motion detecting portion 14. Each of the portions 231, 232 includes a series connected oscillator and amplifier pair, respectively designated 234, 235, 236, 237, and each pair when operative independently produces an AC signal that is supplied to the base input line 238 of a power transistor amplifier 239, which then drives a coupling transformer 240. A diode 241 and RC filter 242 provide any AC signal induced in the secondary of the transformer 240 as a positive generally DC voltage at the point 243, and that DC voltage is supplied via the line 244 as the above-mentioned trigger signal to the hexagonal terminal 99, via the jumper 230 and line 245 to the square Vcc terminal 246 coupled as the Vcc input to the oscillator 234 and amplifier 235 pair, and via the blocking diode 247 to the nodal point 221.

An input circuit of the first portion 231 of the low signal detector bypass 26 includes a parallel connected capacitor 248 and potentiometer 249, the adjustable wiper arm of which is connected to the junction of a capacitor 250 and the cathode of an isolation diode 251, all being coupled via a resistor 252 and line 253 to receive the $E_d$ signal from the downwardly facing triangular terminal 80. The wiper arm of the potentiometer 249 is preferably adjusted to a voltage level of approximately 1 volt higher than the potentiometer 202 to set the voltage level of the $E_d$ signal at which the isolation diode 251 goes from a reverse biased to a forward biased condition at which point the oscillator 234 becomes operational, if receiving a positive Vcc supply from the terminal 246, to provide an AC signal at its output 234*a*. Preferably the amplifier 235 is a voltage follower amplifier with it and the oscillator 234 being part of a single integrated circiut package denoted IC-2 to facilitate connection of the square Vcc supply terminal thereto; and, accordingly, if the oscillator produces an AC signal at its otput 234*a*, that signal will be amplified by the amplifier and passed to drive the transistor 239 and transformer 240. If the $E_d$ voltage exceeds the level set on the potentiometer 249, the isolating diode 251 will be reverse biased and the oscillator 234 will be cut off.

In the second portion 232 of the low signal detector bypass 26 an isolation diode 254 is coupled between the oscillator 236 input line 236*b* and an input circuit including a normally closed mode selection jumper connection shown in solid line 255 to a resistor 256, which is connected to the negative or ground line 257, and also via an input resistor 258 to the bracketed diamond terminal 22 from the output of the motion detecting portion 14. When the isolation diode 254 is reverse biased by a positive output signal from the motion detecting portion 14, the oscillator 236 will be cut off. However, when the motion of an approaching train has been detected by the motion detecting portion, the isolation diode 254 will no longer be reverse biased, and the oscillator 236 will provide an AC output signal at its output 236*a*. Such AC output signal will be amplified in the voltage follower amplifier 237, if the latter is receiving Vcc power from the diamond-shape terminal 16, and such amplified AC output signal is applied to the base input line 238 of the transistor 239 to drive the same. If desired, the mode selection jumper 255, which is normally in the position shown in solid line, may be alternatively connected as shown in the normally open dotted connection 255*a* to a parallel connected resistor 259 and capacitor 260 to the negative line 257 for purposes that will be described in more detail below.

The specific operation of the low signal detector bypass 26 will be described now in more detail with reference to overall operation of the railway signal system 1. Assuming that an appropriate track signal is transmitted in the track 3 by the transmitter 2 and the track signal voltage is below the upper limit of the window set by the high signal detector 27, the track power monitor 20 will effect a positive signal at the upwardly facing triangular terminal 68, which positive signal is supplied as a power signal to the transformer 215 in the low signal detector 25, shown in FIG. 2C. The track signal is received at the receiver 4, and in the motion detecting portion 14 thereof the $E_d$ signal is developed, including a substantially DC voltage with an impressed AC pulse both being proportional to the track signal voltage. The pre-shaped $E_d$ signal is supplied at the downwardly facing triangular terminal 80 at the low signal detector 25, and if the $E_d$ voltage is above the voltage level set on the potentiometer 202, say 24 volts, then the low signal detector will supply a positive voltage at the nodal point 221, and Vcc power will be supplied to the voltage follower amplifiers 15 and 237. Moreover, assuming the jumper 230 is in the position shown, the blocking diode 247 prevents the positive signal at the nodal point 221 from being supplied as the Vcc source to the oscillator 234 and voltage follower amplifier 235, which therefore will be cut off. Assuming further than the motion of an approaching train has not been detected and no train located in the island 5 has been detected by the motion detecting portion 14 or the island control 23, a positive signal will appear at the bracketed diamond terminal 22 in FIG. 2C, which positive signal, first, maintains the isolation diode 254 reverse biased and the oscillator 236 cut off and, second, maintains power to the capacitor 12*a* to effect free running of the astable multivibrator 12 in the system output portion 10. The AC output signal from the astable multivibrator 12 is ampified by the voltage follower amplifier 15, which is then receiving Vcc power, and the signal relay 11 will be picked up.

Now, if the $E_d$ signal voltage exceeds the upper limit of its window, as detected by the high signal detector 27, the track power control 20 is disabled eliminating the positive signal at the upwardly facing triangular terminal 68, and no positive signal will be supplied by the output of the low signal detector 25 at the nodal point 221, which effects removal of the Vcc supply to the voltage follower amplifier 15 causing the signal relay 11 to be dropped. On the other hand, if the $E_d$ voltage supplied at the downwardly facing triangular terminal 80, as shown in FIG. C, were to drop below the low signal level set on the potentiometer 202, the low signal detector 25 again will not provide a positive signal at the nodal point 221, as described above, and the Vcc supply to the voltage follow amplifier 15 will be interrupted causing the signal relay 11 to drop. Regardless of whether or not a Vcc supply is provided the voltage follower amplifier 15, whenever the motion detecting portion 14 detects the motion of an approaching train or a train enters the island monitored by the island control 23, the source of power for the astable multivibrator 12 at the bracket diamond terminal 22 will be eliminated. Therefore, the multivibrator will not provide an AC signal at its output 13 so as to cause or to maintain the signal relay 11 to be in dropped condition.

Again assuming that the $E_d$ signal falls within its predetermined window, say, for example, at 40 volts, and all portions of the railway signal system 1 are operating properly, the signal relay 11 will be picked up. As a train enters a monitored approach, for example, the approach 8*a* traveling in a direction toward the island 5, the $E_d$ voltage will begin to drop at a rate depending on the train approach speed. If the motion detecting portion 14 of the receiver 4 detects motion and causes a zero potential at the bracketed diamond terminal 22 before the low signal detector 25 has detected a low $E_d$ signal, the astable multivibrator 12 will be deenergized causing the signal relay 11 to drop. The isolation diode 254 will no longer be reverse biased causing the oscillator 236 and amplifier 237, which is still receiving a Vcc supply via the low signal detector 25, to produce an AC output signal that drives the transistor 239 and transformer 240. The rectified and filtered output from the transformer 240 is a positive signal that passes via the jumper 230 to the square Vcc supply terminal 246 to the oscillator 234 and voltage follower amplifier 235. As the $E_d$ voltage continues to drop it will reach the voltage level set on the potentiometer 249, and at that time the oscillator 234 and voltage follower amplifier 235 will operate also to drive the transistor 239 and transformer 240 to self-latch the first portion 231 of the low signal detector bypass 26 in an on condition by maintaining a Vcc power at the square terminal 246. Of course, whenever power is supplied to the square Vcc terminal 246, the blocking diode 247 also supplies power to the diamond-shape Vcc terminal 16; and when the $E_d$ voltage drops below the low signal level set on the potentiometer 202 causing the low signal detector 25 to drop out, a positive voltage will be maintained at the nodal point 221 via the diode 247. Moreover, whenever the $E_d$ voltage is above the low signal set point and motion is detected causing the second portion 232 of the low signal detector bypass 26 to be operational, the positive signal appearing at the point 243 also acts as the trigger signal over the line 244 via the hexagonal terminal 99 to operate the broken rail detector bypass 98 de-energizing the broken rail detector 28 and to operate the lock out timing circuit 30 in the manner described above.

Continuing with both the first and second portions 231, 232 of the low signal detector bypass 26 being operational, as the last car of a train leaves the island 5, the motion detecting portion 14 will recover rapidly, especially with the aid of the automatic gain control arrangement 124, to supply again a positive signal at the bracketed diamond terminal 22. That positive signal supplies power to the astable multivibrator 12 effecting pick up of the signal relay 11 and also reverse biases the isolation diode 254 effecting cut off of the second portion 232 of the low signal detector bypass 26. When the distance between the last train car and the island is sufficiently great that the $E_d$ voltage has risen above the low signal set point on the potentiometer 202, the low signal detector will supply a positive signal to the nodal point 221 to maintain a Vcc supply to the voltage follower amplifiers 15 and 237. After the $E_d$ voltage has risen another volt the first portion 213 of the low signal detector bypass circuit 26 is cut off. At this time the railway signal system 1 is fully recovered and capable of subsequent operation to detect an approaching train, a broken rail, a low signal condition or the like.

To bypass the low signal detector the jumper 230 may be removed and placed to make the connection 230*a* shown in dotted line in FIG. 2C, and a continuous Vcc supply will be provided to the oscillator 234 and voltage follower amplifier 235 in the first portion 231 of the low signal detector bypass 26. Assuming that the potentiometer 249 is set at a voltage level approximately one volt above the voltage level set on the potentiometer 202, that first portion will provide an AC output signal driving the transistor 239 and transformer 240 to ensure the supply of Vcc power to the voltage follower amplifier 15 in the output portion 10 even after the low signal detector 25 has detected the occurrence of a low $E_d$ signal. Thus, the connection of the jumper 230 determines whether or not the low signal detector 25 is bypassed. However, regardless of the jumper 230 connection, the high signal detector 27 and broken rail detector 28 still will be fully operational via the upwardly facing triangular input terminal 68 in the low signal detector 25 in the manner described above.

Is is possible that an unexpected shunt may occur across the track rails at a location within the monitored approach, caused, for example, by a wire or other conductor falling between the track rails and electrically connecting the same. Upon the occurrence of such an unexpected shunt, the $E_d$ voltage will drop instantaneously causing a brief detection of motion by the motion detecting portion 14, which, first, interrupts power to the astable multivibrator 12 causing the signal relay 11 to drop and, second, effects immediate operation of the second portion 232 of the low signal detector bypass 26 that provides a Vcc supply to both the diamond-shape terminal 16 and the square terminal 246 and also provides a trigger signal to operate the time delay lock out circuit 30. If the unexpected shunt allows the $E_d$ voltage to remain above the low signal level, after the circuit 30 times out, the system 1 will operate normally to monitor the track from the unexpected shunt to the island. If, on the other hand, the unexpected shunt causes the $E_d$ voltage to drop below the low signal level causing the low signal detector 25 to drop out, the capacity of the RC filter 222 between the nodal point 221 and the diamond-shape Vcc supply terminal 16 briefly maintains a Vcc supply to the voltage follower amplifiers 15 and 237 until the second portions 232 of the low signal detector bypass 26 start up to drive the transistor 239 and transformer 240 to maintain the Vcc power to both Vcc terminals 16 and 246. Moreover, the low $E_d$ voltage will also cause the first portion 231 to start up after the capacitors 248, 250 have discharged, and the first portion 231 will remain operational even after the time delay lock-out circuit 30 has expired. Upon such expiration the motion detecting portion 14 provdes a positive signal at the bracketed diamond terminal 22 energizing the astable multivibrator 12 to pick up the signal relay 11 and also cutting off the oscillator 236. Thus, with the low signal detector 25 now being bypassed by the first portion 231 of the low signal detector bypass 26 to maintain Vcc power at the terminals 16 and 246, the railway signal system 1 will be operational to detect the motion of an approaching train in the shortened approach that extends between the unexpected shunt and the island 5.

The above described operation of the low signal detector bypass 26 upon occurrence of an unexpected shunt that causes the $E_d$ voltage to drop instantly below the low signal level may be avoided if it is desired to drop the signal relay 11 whenever the track and $E_d$ signals drop below the low signal level. Such changed operation may be effected by changing the connection of the jumper 255 to the connection shown in dotted line 255*a* in the second portion 232 of the low signal detector bypass. The capacity of the capacitor 260 is preferably larger than the capacity of the RC filter 222. Therefore, when the low $E_d$ voltage occurs, due to the mentioned unexpected shunt, the low signal detector 25 will drop out and Vcc power from the RC filter 222 particularly to the voltage follower amplifier 237 will be dissipated before the capacitor 260 has discharged to gain operation of the oscillator 236. Therefore, the low signal detector bypass 26 will not operate to maintain Vcc power at either of the terminals 16 or 246, and the signal relay 11 will remain dropped until the unexpected shunt is removed.

From the foregoing description it should now be clear that the railway signal system 1 is operative to detect a train on a track approaching an island area defined between the system track tie points and to produce a system output signal, for example that drops a signal relay, indicative of detection of such an approaching train. The system 1 is self-monitoring and also monitors track and ballast conditions so as to produce the system output signal, for example, when any system portion fails to operate properly, when the track ballast impedance varies radically, when a broken rail occurs, and so on as described in detail above.

The embodiments of the invention in which an exclusive property or privilege is claimed are defined as follows:

1. A railway signal system for monitoring a railroad track to produce a system output signal upon detecting a train on the monitored track, comprising: transmitter means for generating an electric signal; coupling means for coupling such electric signal to the track for transmission therein as a track signal; receiver means coupled to the track for receiving such track signal, said receiver means including detecting means responsive to a change in such track signal caused by such a train for detecting the same and thereupon to effect production of such system output signal, and power monitor means coupled to said transmitter means and responsive to the power level of such electric signal for producing a first power indicating signal when such power level is within a predetermined operational range and a second power indicating signal when such power level is outside such range, said power monitor means including latching means responsive to production of such second power indicating signal for latching up said power monitor means to continue producing such second power indicating signal.

2. A system as set forth in claim 1, further comprising reset means for selectively resetting said power monitor means to enable the same to produce such first power indicating signal.

3. A system as set forth in claim 1, further comprising output circuit means coupled to said detecting means for producing such system output signal when the latter has detected such a train, and said ouput circuit means being coupled to said power monitor means and responsive to such power indicating signals so as to produce such system output signal also upon occurrence of such second power indicating signal.

4. A system as set forth in claim 3, such electric signal being an AC signal, and said detecting means including motion detecting means responsive to changes in such track signal caused by a train approaching the system tie points to the track for detecting such approaching train.

5. A system as set forth in claim 4, said motion detecting means including means for developing a control signal having an average substantially DC voltage level proportionally representative of the voltage of such track signal; and high signal detector means responsive to such control signal and coupled to said power monitor means for causing the latter to produce such second power indicating signal when the voltage level of such control signal exceeds a predetermined voltage.

6. A system as set forth in claim 4, said motion detecting means including means for developing a control signal having an average substantially DC voltage level proportionally representative of the voltage of such track signal; and broken rail detector means responsive to such control signal and coupled to said power monitor means for causing the latter to produce such second power indicating signal upon the occurrence of a rapid increase in the voltage of such control signal caused by the occurrence of a broken rail in the monitored track; and disable circuit means coupled to said broken rail detector means for preventing the latter from causing said power monitor means to produce such second power indicating signal when said motion detecting means has already effected production of such system output signal unless such control signal rapidly rises above a predetermined maximum level.

7. A system as set forth in claim 4, said power monitor means including input means for supplying an AC input signal proportionally representative of the current of such track signal, an amplifier, transistor means AC coupled to said amplifier and responsive to such AC input signal for causing said amplifier to produce an AC output signal, and power monitor output circuit means coupled to said amplifier for producing such first power indicating signal as a DC track power control signal when said amplifier produces an AC output signal and such second power indicating signal as a substantially zero track power control signal when said amplifier does not produce an AC output signal.

8. A system as set forth in claim 7, said motion detecting means including means for developing a control signal having an average substantially DC voltage level proportionally representative of the voltage of such track signal; and high signal detector means responsive to such control signal and coupled to said transistor to saturate the same causing said amplifier and power monitor output circuit means to produce a substantially zero track power control signal and also causing said output circuit means to produce such system output signal when the voltage level of such control signal exceeds a predetermined voltage.

9. A system as set forth in claim 8, further comprising broken rail detector means responsive to such control signal and coupled to said transistor to saturate the same causing said amplifier and power monitor output circuit means to produce a substantially zero track power control signal and also causing said output circuit means to produce such system output signal upon the occurrence of a rapid increase in the voltage of such control signal caused by the occurrence of a broken rail in the monitored track; and disable circuit means coupled to said broken rail detector means for preventing the latter from causing said power monitor means to produce such zero track power control signal when said motion detecting means has already effected production of such system output signal unless such control signal rapidly rises above a predetermined maximum level.

10. A system as set forth in claim 8, said input means including adjustable means for adjusting the gain of said power monitor means, and selectively operable means for effecting a fixed gain of said power monitoring means, whereby upon selective operation of said selectively operable means to effect such a fixed gain the voltage of such DC track power control signal is directly proportional to the current of such track signal.

11. A system as set forth in claim 8, said power monitor means further comprising indicator means responsive to said power monitor output circuit means for positively indicating the production of such second power indicating signal.

12. A system as set forth in claim 8, said transmitter means including automatic gain control means responsive to such control signal for normally maintaining the track signal voltage within a predetermined range.

13. A system as set forth in claim 8, said latching means including a power connection between said power monitor output circuit means and the collector of said transistor, and further comprising reset means including means for supplying power to said transistor collector independently of the power indicating signal of said power monitor means.

14. A railway signal system for monitoring a railroad track to produce a system output signal upon detecting a train on the monitored track, comprising: transmitter means for generating an electrical signal; coupling means for coupling such electrical signal to the track for transmission therein as a track signal; receiver means coupled to the track for receiving such track signal, said receiver means including detecting means responsive to a change in such track signal caused by such a train for detecting the same, and said detecting means including an amplifier means for developing a control signal having at least a DC signal component the voltage of which is proportionally representative of the voltage of such track signal, and said detecting means being responsive to such control signal for effecting production of such system output signal; and automatic gain control means for increasing the gain of said amplifier means when the voltage of such DC signal component drops below a predetermined level as such a train approaches the system tie points to the track, whereby upon occurrence of a train leaving the track island defined between the system tie points to the track the magnitude of such control signal rapidly increases and said detecting means also rapidly ceases to effect production of such system output signal.

15. A system as set forth in claim 14, such electric signal being an AC signal, said amplifier means producing such control signal also with a proportional AC pulse impressed on such DC signal component, and said detecting means including movement detector means coupled to said amplifier means and responsive to such control signal for effecting production of such system output signal when the rate of decrease of such DC signal component caused by a train approaching the system tie points to the track exceeds the rate of increase of such AC pulse component.

16. A system as set forth in claim 15, said movement detector means comprising further amplifier means having a variable effective gain over the major extent of the operational range thereof, the magnitude of such effective gain being determined by the characteristics of a received input signal, wave shaping circuit means for producing from such control signal shaped DC signal and AC pulse components, capacitor means for normally blocking such shaped DC signal component from said further amplifier means and for normally passing such shaped AC pulse component to said amplifier means, whereby upon receipt of such shaped AC pulse component said further amplifier means produces an AC output signal and upon decrease of such shaped DC signal component at a rate greater than the rate of increase of such shaped AC pulse component said further amplifier means produces a DC output signal, and such production of such DC output signal correspondingly effecting production of such system output signal, and said automatic gain control means being coupled between an input to said wave shaping circuit means and to said amplifier means for causing said DC signal component to increase rapidly upon occurrence of a train leaving the track island, whereby said further amplifier means again produces an AC output signal in response to receipt of such AC pulse component.

17. A railway signal system for monitoring a railroad track to produce a system output signal upon detecting a train on the monitored track, comprising: transmitter means for generating an electric signal; coupling means for coupling such electric signal to the track for transmission therein as a track signal; receiver means coupled to the track for receiving such track signal, said receiver means including detecting means responsive to a change in such track signal caused by such a train for detecting the same and thereupon to effect production of such system output signal; and time delay lock-out means for maintaining production of such system output signal for a predetermined duration in response to the occurrence of said detecting means effecting production of such system output signal.

18. A system as set forth in claim 17, said time delay lock-out means comprising a monostable multivibrator normally producing a first output signal and upon receipt of a trigger input signal producing a second output signal for such predetermined duration.

19. A system as set forth in claim 18, further comprising island control means for detecting the presence of a train in the track island defined between the system tie points to the track, said island control means being coupled to said monostable multivibrator for discharging the same to ensure production of its first output signal upon detecting the presence of such a train in the track island.

20. A system as set forth in claim 17, such electric signal being an AC signal, and said detecting means comprising motion detecting means including an amplifier for developing a control signal having a DC signal component and a proportional AC pulse component impressed thereon, the voltage of such components being also proportionally representative of the voltage of such track signal, and movement detector means coupled to said amplifier and responsive to such control signal for effecting production of such system output signal when the rate of decrease of such DC signal component caused by a train approaching the system tie points to the track exceeds the rate of increase of such AC pulse component; further means for causing said movement detector means to effect production of such system output signal independent of such control signal to the latter; said time delay lock-out means being coupled to said further means for operating the same to cause said movement detector means to effect production of such system output signal for such predetermined duration; and trigger circuit means coupled to said time delay lock-out means and responsive to the occurrence of said motion detecting means detecting such an approaching train for applying a trigger signal to said time delay lock-out means causing the same to operate said further means for such predetermined duration.

21. A system as set forth in claim 20, further comprising low signal detector means coupled to said motion detecting means for producing an AC output signal when the average level of such DC signal component is above a predetermined voltage and a DC output signal when such voltage level is below such predetermined voltage; and means for AC coupling said low signal detector means as a power input to said trigger circuit means, whereby an AC output signal produced by said low signal detector means will be coupled as the power input to drive said trigger circuit means when said movement detector means has effected production of such system output signal in response to detection of an approaching train on the monitored track.

22. A system as set forth in claim 21, said trigger circuit means comprising an oscillator having an input and an output, a voltage follower amplifier having an input coupled to said output of said oscillator, means for AC coupling said low signal detector means as a power supply to at least one of said oscillator and voltage follower amplifier, diode gate means coupled between said input of said oscillator and said movement detector means for cutting off said oscillator when the motion of an approaching train has not been detected and for permitting said oscillator to produce an AC oscillating signal when such motion has been detected, whereby when such AC output signal from said low signal detector means is produced and said movement detector means detects an approaching train on the monitored track, said oscillator and voltage follower amplifier produce an amplified AC oscillating signal, and further AC coupling means for providing such trigger signal as a DC trigger signal to said time delay lock-out means in response to receiving such amplifier AC oscillating signal.

23. A railway signal system for monitoring a railroad track to produce a system output signal upon detecting a train on the monitored track, comprising: transmitter means for generating an electric signal; coupling means for coupling such electric signal to the track for transmission therein as a track signal; receiver means coupled to the track for receiving such track signal, said receiver means including detecting means responsive to a change in such track signal caused by such a train for detecting the same and thereupon to effect production of such system output signal, said detecting means including means for developing a control signal having an average substantially DC voltage component proportionally representative of the voltage of such track signal; broken rail detector means coupled to said detecting means for effecting production of such system output signal upon occurrence of a rapid increase in the voltage of such control signal caused by the occurrence of a broken rail in the monitored track; and disable circuit means coupled to said broken rail detector means for preventing the latter from effecting production of such system output signal when said detecting means has already effected production of such system output signal.

24. A system as set forth in claim 23, said broken rail detector means comprising a threshold detector having a first input coupled to receive such control signal and a second input coupled to a bias circuit to receive a bias voltage therefrom, said threshold detector producing a first output signal when such control signal voltage exceeds such bias voltage and a second output signal when such control signal voltage does not exceed such bias voltage, such second output signal being effective to cause production of such system output signal, and said disable circuit means being responsive to said detecting means having effected production of such system output signal for developing a disable output signal at its output, and said disable circuit output being coupled to said second input of said threshold detector to supply such disable output signal to the same in order to preclude said threshold detector from producing such second output signal.

25. A system as set forth in claim 23, further comprising trigger circuit means coupled to said detecting means for producing a trigger signal in response to the latter detecting such a train; and means for coupling said trigger circuit means to said disable circuit means for operation of the same to produce such disable output signal to prevent said broken rail detector means from effecting production of such system output signal.

26. A system as set forth in claim 25, further comprising low signal detector means coupled to said detecting means for producing an AC output signal when such control signal voltage exceeds a predetermined voltage and a DC output signal when such control signal voltage is below such predetermined voltage, said low signal detector means being coupled to said trigger circuit means to effect disabling thereof when said low signal detector produces such DC output signal.

27. A system as set forth in claim 26, said trigger circuit means including self-latch means to maintain the same operational to produce such trigger signal when said detecting means has effected production of such system output signal before such control signal voltage has dropped below such predetermined voltage and to maintain production of such trigger signal until said detecting means no longer effects production of such system output signal and said low signal detector means again produces such AC output signal.

28. A system as set forth in claim 23, such electric signal being an AC signal, and said detecting means comprising motion detecting means for detecting changes in such track signal caused by a train approaching the system tie points to the track.

29. A railway signal system for monitoring a railroad track to produce a system output signal upon detecting a train on the monitored track, comprising: transmitter means for generating an electric signal; coupling means for coupling such electric signal to the track for transmission therein as a track signal; receiver means coupled to the track for receiving such track signal, said receiver means including detecting means for detecting such a train, said detecting means being responsive to a change in such track signal to produce a first signal when no train is detected and a second signal when such a train is detected for effecting production of such system output signal, said detecting means including means for developing a control signal having an average substantially DC voltage level proportionally representative of the voltage of such track signal; low signal detector means coupled to said detecting means for producing an AC output signal when the voltage level of such control signal is above a predetermined voltage and a DC output signal when such voltage level is below such predetermined voltage; output circuit means coupled to said detecting means for producing such system output signal when the latter has detected such a train and produced such second signal; and AC coupling means for AC coupling said low signal detector means to said output circuit means to supply a power input signal thereto, whereby a DC output signal from said low signal detector means will effect removal of such power input signal causing said output circuit means to produce such system output signal.

30. A system as set forth in claim 29, said low signal detector means comprising Schmitt trigger circuit means for producing an output signal at its output when the input signal to its input exceeds a predetermined level, input circuit means for modifying such control signal to determine the DC voltage level thereof required to cause said Schmitt trigger circuit means to produce such an output signal, and chopper means coupled between said input circuit means and said input to said Schmitt trigger circuit means for AC modulating the modified control signal prior to its application to said Schmitt trigger circuit means, whereby said Schmitt trigger circuit means produces an AC output signal when such control signal exceeds such predetermined level and produces a substantially zero output signal when the voltage level of such control signal is below such predetermined level.

31. A system as set forth in claim 30, said AC coupling means comprising a transistor coupled to receive the output signal from said Schmitt trigger circuit means, a transformer having a primary connected for energization by said transistor and a secondary coupled to supply such power input signal to said output circuit means.

32. A system as set forth in claim 31, further comprising power monitor means coupled to said transmitter means and responsive to the power level of such electric signal for producing a first power indicating signal when such power level is within a predetermined operational range and a second power indicating signal when such power level is outside such range, such first power indicating signal being a DC voltage signal and such second power indicating signal being a substantially zero signal, said power monitor means being coupled to said transformer primary for supplying a power signal to the same, whereby production by said power monitor means of such second power indicating signal causes said AC coupling means to terminate supplying such power input signal to said output circuit means.

33. A system as set forth in claim 32, said power monitor means including latching means responsive to production of such second powerindicating signal for latching up said power monitor means to continue producing such second power indicating signal, and reset means for selectively resetting said power monitor means to enable the same to produce such first power indicating signal.

34. A system as set forth in claim 30, said input circuit means including an RC filter and a potentiometer; and said chopper means including a free-running oscillator means for producing an AC oscillator signal and a transistor coupled to said free-running oscillator means and cyclically being driven to conduction and non-conduction by such AC oscillator signal, whereby said transistor interrupts such modified control signal from said Schmitt trigger circuit input when in conduction and permits such modified control signal to pass to said Schmitt trigger circuit input when not in conduction.

35. A system as set forth in claim 29, further comprising bypass circuit means coupled to said detecting means and operational upon receipt of such second signal for supplying such power input signal to said output circuit means, said bypass circuit means requiring operational power to effect its function; said AC coupling means being connected to said bypass circuit means to supply operational power to the latter when such control signal voltage exceeds such predetermined voltage, whereby when such control signal equals or is below such predetermined voltage no operational power is supplied from said AC coupling means to said bypass circuit means; and self-latch circuit means operational to maintain a supply of operational power to said bypass circuit means and to said output circuit means when the voltage level of such control signal is less than a further predetermined voltage greater than such predetermined voltage.

36. A system as set forth in claim 35, said self-latch circuit means requiring a supply of operational power to effect its function; and further comprising means for coupling said bypass circuit means to an operational power input of said self-latch circuit means to supply operational power to the latter when said bypass circuit means is operational.

37. A system as set forth in claim 36, said bypass circuit means comprising a series connected free-running oscillator and amplifier, said oscillator having a control input, diode gate means coupled between said control input and said detecting means for cutting off said oscillator when such first signal is produced and for permitting said oscillator to produce an AC oscillating signal when such second signal is produced; and said self-latch circuit comprising a series connected further free-running oscillator and further amplifier, said further oscillator having a control input, further input circuit means coupled to said means for developing for establishing such further predetermined voltage, a further diode gate means coupled between said control input of said further oscillator and said further input circuit means for cutting off said further oscillator when such control signal voltage exceeds such further predetermined voltage and for permitting said further oscillator to produce a further AC oscillating signal when such control signal voltage is less than such further predetermined voltage.

38. A system as set forth in claim 37, said means for coupling comprising further AC coupling means having an input and an output for providing a DC operational power signal at its output upon receipt of an AC input signal at its input from at least one of said bypass circuit means and self-latch circuit means, said further AC coupling means output being coupled to said means for coupling and to said AC coupling means.

39. A system as set forth in claim 38, said AC coupling means including an RC output filter having a first capacity for maintaining a power input signal to said output circuit means and a supply of operational power to said bypass circuit means for a first duration after said low signal detector means begins to produce a DC output signal.

40. A system as set forth in claim 39, further comprising an RC circuit having a second capacity larger than such first capacity coupled between said diode gate means and said detecting means to maintain said oscillator cut off until after said RC output filter has discharged following production of such DC output signal by said low signal detector.

41. A system as set forth in claim 40, such electric signal being an AC signal, and said detecting means comprising motion detecting means for detecting changes in such track signal caused by a train approaching the system tie points to the track.

42. A system as set forth in claim 36, said AC coupling means including an RC output filter having a first capacity for maintaining a power input signal to said output circuit means and a supply of operational power to said bypass circuit means for a first duration after said low signal detector begins to produce a DC output signal.

43. A system as set forth in claim 42, further comprising an RC circuit having a second capacity larger than such first capacity coupled between said diode gate means and said detecting means to maintain said oscillator cut off until after said RC output filter has discharged following production of such DC output signal by said low signal detector.

44. A system as set forth in claim 43, such electric signal being an AC signal, and said detecting means comprising motion detecting means for detecting changes in such track signal caused by a train approaching the system tie points to the track.

45. A system as set forth in claim 29, such electric signal being an AC signal, and said detecting means comprising motion detecting means for detecting changes in such track signal caused by a train approaching the system tie points to the track.

46. A railway signal system for monitoring a railroad track to produce a system output signal upon detecting a train on the monitored track, comprising: transmitter means for generating an electric signal; coupling means for coupling such electric signal to the track for transmission therein as a track signal; receiver means coupled to said track for receiving such track signal, said receiver means including a train detecting portion and a signal monitoring portion; said train detecting portion including train detecting means responsive to a change in such track signal caused by a train on the monitored track for effecting production of such system output signal, said train detecting means producing an AC output signal when no train is detected and a DC output signal when a train is detected; said signal monitoring portion including monitor means responsive to the voltage and current parameters of such track signal for effecting production of such system output signal when at least one of such parameters is outside a predetermined range of desirable levels, said signal monitoring portion producing an AC output signal when such parameters are at satisfactory levels and a DC output signal when at least one of such parameters is at an undesirable level; output circuit means for producing such system output signal, said output circuit means including first and second stages, each having an input for receiving a respective input signal to effect operation of the same, whereby upon termination of an input signal to at least one of said stages said output circuit means produces such system output signal; and first means for AC coupling said train detecting portion to said input of said first stage to supply an input signal thereto when said train detecting portion produces an AC output signal, and second means for AC coupling said signal monitoring portion to said input of said second stage to supply an input signal thereto when said signal monitoring portion produces an AC output signal.

47. A system as set forth in claim 46, said first stage of said output circuit means comprising an astable multivibrator, and said first means including means for supplying such a respective input signal as a substantially DC power signal to said astable multivibrator to effect free-running thereof to produce an AC output signal.

48. A system as set forth in claim 47, said second stage of said output circuit means comprising a voltage follower amplifier connected in series with said astable multivibrator, and said second means including means for supplying such a respective input signal as a Vcc power signal to said voltage follower amplifier energizing the same to produce an amplified AC output signal in response to a received AC input signal from said multivibrator.

49. A system as set forth in claim 48, said output circuit means further comprising further AC coupling means receiving an input from said voltage follower amplifier for supplying such system output signal as a substantially zero signal when no amplified AC output signal is produced by said voltage follower amplifier, said further AC coupling means being operable to supply an AC system signal in response to a received amplified AC output signal from said voltage follower amplifier.

50. A system as set forth in claim 46, said monitor means including power monitor means coupled to said transmitter means for monitoring the current of such electric signal coupled to the track.

51. A system as set forth in claim 46, said train detecting means including means for developing a control signal having a substantially average DC voltage proportionally representative of the voltage of such track signal; and said monitor means including means for detecting whether said control signal voltage falls within a predetermined voltage range.

52. A system as set forth in claim 51, said means for detecting including a low signal detector to detect a control signal voltage below the lower limit of such range; and further comprising a bypass circuit for said low signal detector, said bypass circuit being responsive to the production of such a DC output signal by said train detecting means prior to said low signal detector detecting a control signal voltage below the lower limit of such range for supplying a respective input signal to said second stage of said output circuit means.

53. A system as set forth in claim 52, such electric signal being an AC signal, and said train detecting means comprising motion detecting means for detecting changes in such track signal caused by a train approaching the system tie points to the track.

54. A system as set forth in claim 46, such electric signal being an AC signal, and said train detecting means comprising motion detecting means for detecting changes in such track signal caused by a train approaching the system tie points to the track.

55. In a railway signal system for monitoring a railroad track to produce a system output signal upon detecting a train on the monitored track, including a transmitter that transmits a track signal in the track and a receiver responsive to such transmitted track signal to effect production of such system output signal when a train is detected on the monitored track, the improvement comprising an automatic gain control in said transmitter and responsive to a control signal developed in said receiver in proportion to the track signal voltage normally to maintain the track signal voltage within a predetermined range.

56. In a railway signal system as set forth in claim 55, further comprising means responsive to a track signal voltage outside such range for causing production of such system output signal.

* * * * *